US007337476B2

(12) United States Patent
Green

(10) Patent No.: US 7,337,476 B2
(45) Date of Patent: Mar. 4, 2008

(54) VENTILATED TOILET SEAT

(76) Inventor: Donald L. Green, 7850 County Rd 130, Red Rock, OK (US) 74651-0309

( * ) Notice: Subject to any disclaimer, the term of this patent is extended or adjusted under 35 U.S.C. 154(b) by 374 days.

(21) Appl. No.: 11/049,084

(22) Filed: Feb. 2, 2005

(65) Prior Publication Data

US 2005/0166305 A1 Aug. 4, 2005

Related U.S. Application Data

(60) Provisional application No. 60/541,077, filed on Feb. 2, 2004.

(51) Int. Cl.
*E03D 9/052* (2006.01)

(52) U.S. Cl. ..... 4/213; 4/217

(58) Field of Classification Search ..... 4/213, 4/217

See application file for complete search history.

(56) References Cited

U.S. PATENT DOCUMENTS

| | | | | |
|---|---|---|---|---|
| 2,124,017 | A * | 7/1938 | Vandiver | 4/217 X |
| 4,748,698 | A * | 6/1988 | Kao | 4/217 |
| 4,984,310 | A * | 1/1991 | Casale | 4/217 X |
| 6,167,576 | B1 | 1/2001 | Sollami | 4/217 |
| 6,202,226 | B1 | 3/2001 | Shoptaugh | 4/213 |
| 6,209,146 | B1 | 4/2001 | Gonzalez | 4/213 |
| 6,237,163 | B1 | 5/2001 | Guzzo et al. | 4/213 |
| 6,260,215 | B1 | 7/2001 | Miller | 4/217 |
| 6,449,778 | B1 | 9/2002 | Franco | 4/217 |
| 6,496,986 | B1 | 12/2002 | Lumsden | 4/213 |
| 6,546,567 | B2 * | 4/2003 | Kuzniar | 4/217 |
| 2003/0070212 | A1 | 4/2003 | Brodhead | 4/217 |

* cited by examiner

*Primary Examiner*—Robert M. Fetsuga
(74) *Attorney, Agent, or Firm*—Martin S. High, P.C.

(57) ABSTRACT

The invention comprises a toilet seat that forms a hollow inside chamber that runs within the toilet seat. The bottom surface of the toilet seat also forms a plurality of linear, elongated louvers to allow a sweeping motion of air across the underside surface of the toilet seat and into the hollow inside chamber. These openings are oriented to establish a horizontal movement of the air inside the perimeter of the toilet seat to minimize the escape of odors from the toilet bowl. The toilet seat also forms a rear opening that a fan that withdraws air from the hollow inside chamber. The exhaust air passes through an odor adsorbing chamber adsorbing odors. The air is then expelled into the room back and downward, away from the user. Alternatively, the exhaust is channeled ventilation piping in the structure to be exhausted to the outside.

3 Claims, 10 Drawing Sheets

VENTILATED TOILET SEAT

CROSS-REFERENCE TO RELATED APPLICATIONS

This application claims the benefit of U.S. Provisional Application No. 60/541,077 filed on Feb. 2, 2004 titled "Ventilated Toilet Seat," which is incorporated herein by reference.

BACKGROUND OF THE INVENTION

1. Field of the Invention

It is all too common that when people use toilets for the purpose of disposing of excrement that unpleasant odors are released. The purpose of the instant invention is to capture these odors before they are released to the room and escape into adjoining areas of the building whether the building is a home or commercial structure. The instant invention solves this delicate problem by combining a ventilation system integral to the toilet seat and an organic odor capture system to eliminate the odors at the source in a quiet, low-profile system. The instant invention relates to the new construction of new and refurbishing of existing bathroom fixtures. Specifically, the instant invention deals with the bathroom fixtures dealing with the toilet. More specifically, the instant invention involves toilet fixtures involving the toilet seat.

2. Description of Related Art

It is always desirous to remove any odor that is generated by the normal use of the toilet. Therefore, it is clearly desirous to have a system, integral with the toilet seat or cover that is capable of removing those odors.

BRIEF SUMMARY OF THE INVENTION

The invention comprises a toilet seat that forms a hollow inside chamber that runs inside the majority of the toilet seat. This hollow chamber is formed within the toilet seat and is integral to the toilet seat. The toilet seat also forms a plurality of essentially linear, elongated openings in the bottom surface of the toilet seat to allow air to flowing to the hollow chamber. The plurality of linear, elongated openings in the bottom surface are oriented to establish a horizontal movement of the air inside the perimeter of the toilet seat in order to minimize the escape of odors from the toilet bowl.

At the back of the toilet seat, near the hinged connection to the toilet, an opening is formed by the toilet seat that serves as an exhaust port for the hollow inside chamber. This opening allows for mounting of a battery or wall socket powered fan that pulls air from the hollow inside chamber.

In one embodiment of the invention, the hollow inside chamber can retain odor porous adsorbing material capturing offensive odors as the air passes through the hollow inside chamber and out through the powered fan. In the most common embodiment the hollow inside chamber is used to act as a conduit for air circulation to a separate or additional chamber to adsorb the offensive odors from the air.

DETAILED DESCRIPTION OF THE INVENTION

The invention, the ventilated toilet seat 10, is comprised of a standard shaped toilet seat 21 or a split toilet seat that forms a hollow inside chamber that runs inside the majority of the ventilated toilet seat 10. In the disclosure that follows, the instant invention will be described in terms of a standard shaped residential toilet seat 21, but the instant invention can be applied to a split toilet seat as well. The hollow inside chamber is formed inside the toilet seat 21. The toilet seat 21 has a bottom surface, which is an essentially flat surface. The toilet seat 21 also has a top surface 41 which combined with the bottom surface 24 forms a toilet seat with an essentially oval shaped inner circumference. The hollow inside chamber is formed inside the toilet seat 21 and is formed by and lies between the top surface 41 and the bottom surface 24. The top surface 41 and bottom surface 24 can form either a split style, typically used in commercial applications, or a non-split style, typically used in residential applications, ventilated toilet seat.

Figure 1:
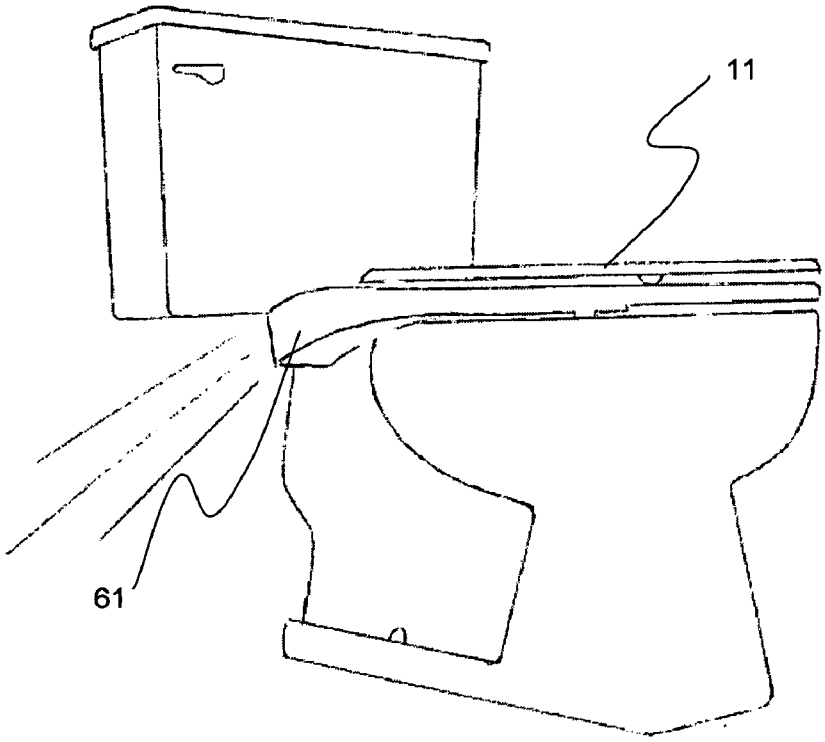
FIG. 1 is an elevation view of the ventilated toilet seat.
Figure 2:
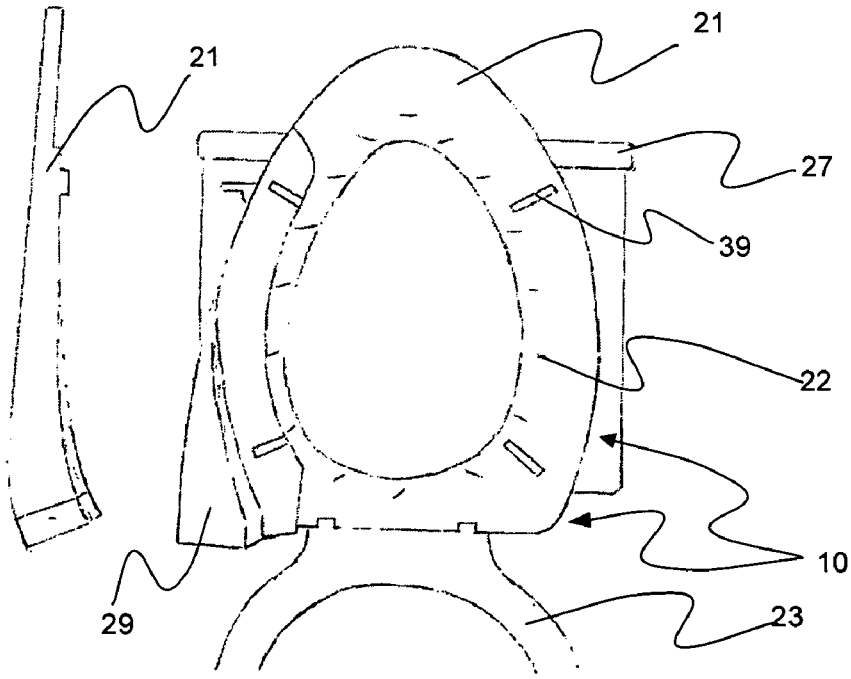
FIG. 2 is a front view of the ventilated toilet seat shown in the up or open position.
Figure 3:
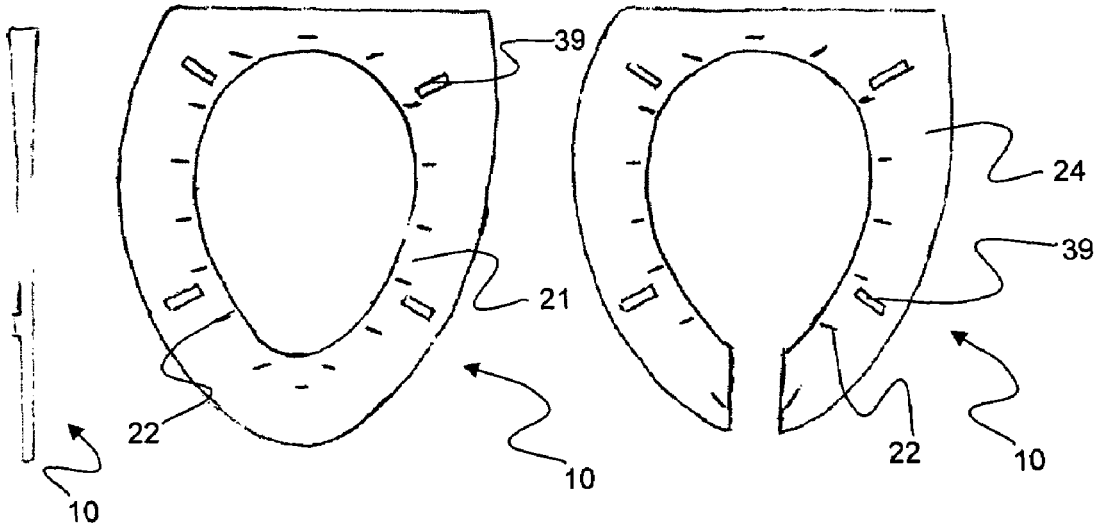
FIG. 3 is a view of two modes of operation using a split seat, which is more found in commercial applications, and a non-split seat 21 that is more commonly found in residential applications.
Figure 4A:
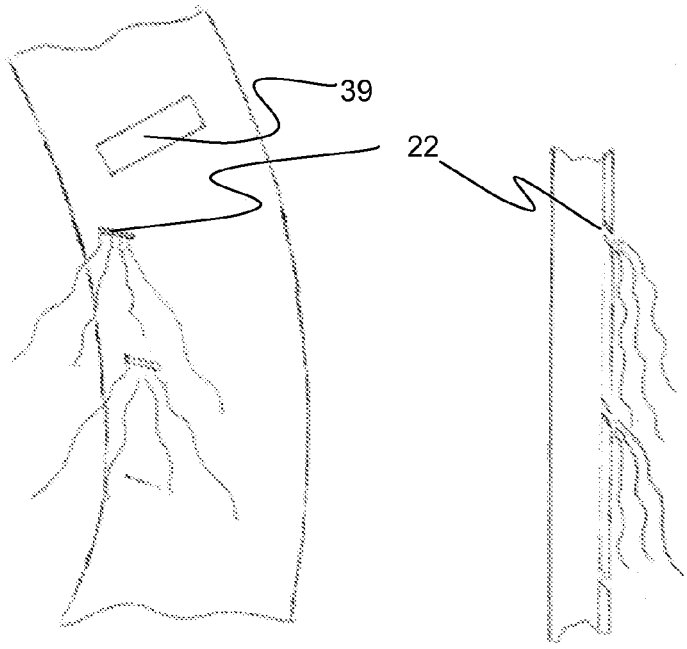
FIG. 4*a* is a view showing the approximate air streamlines in the vicinity of the louvers.
Figure 4B:
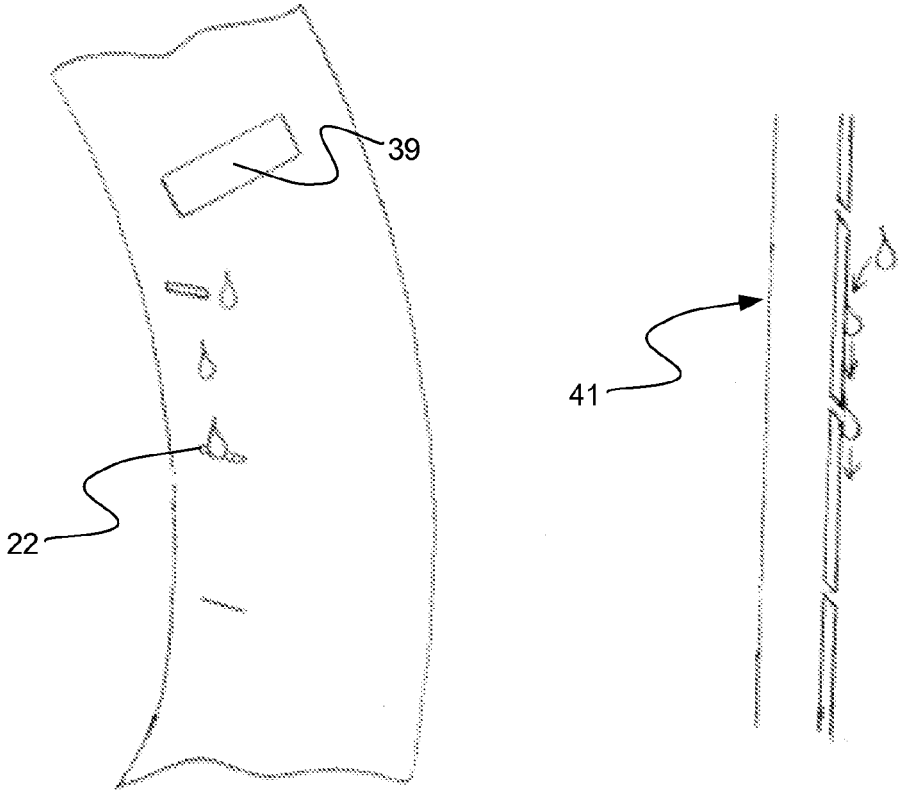
FIG. 4*b* shows the movement of liquid when the toilet seat is in the upright orientation showing how liquid is shed from the seat.
Figure 5:
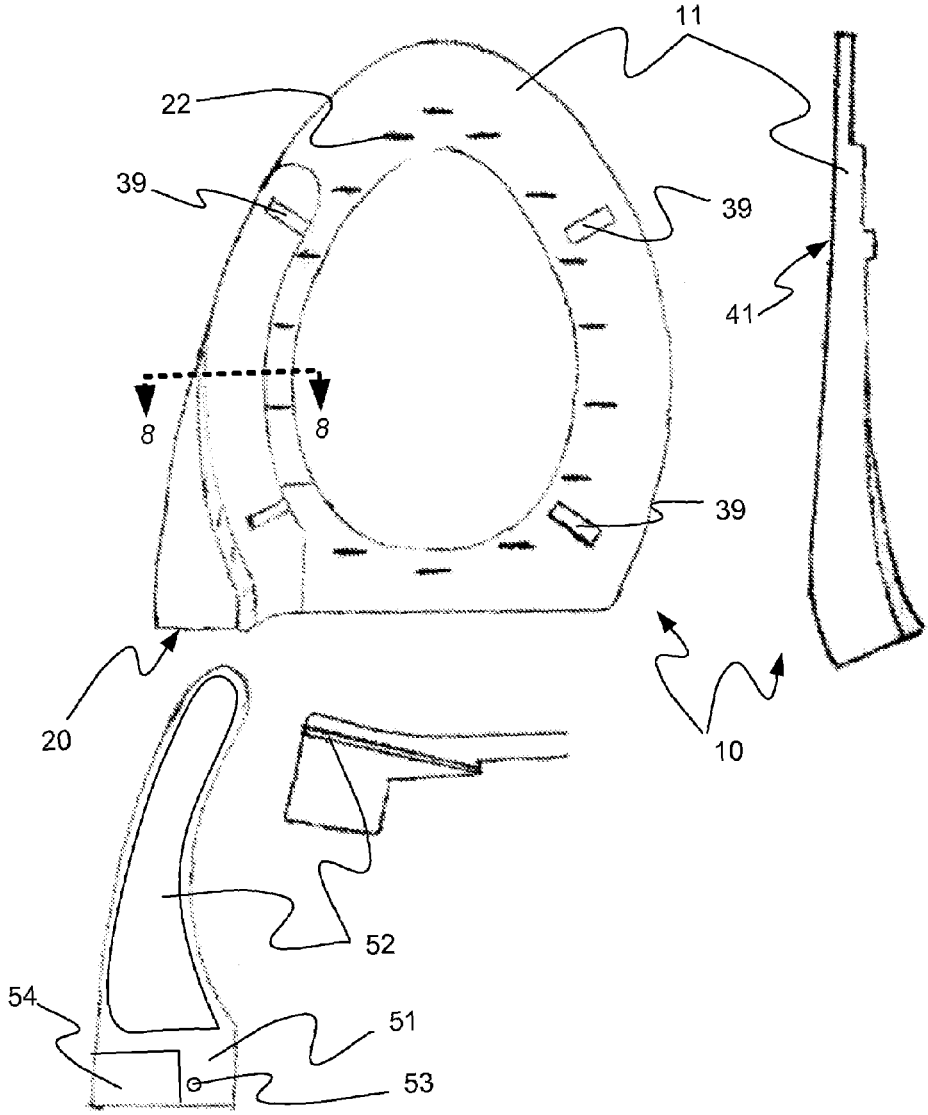
FIG. 5 shows one embodiment of the instant invention with the placement of the filter unit and how the filter unit engages into the molded toilet seat from the rear of the instant invention.

The bottom surface 24 of the toilet seat is that portion of the toilet seat that comes into proximity with the toilet 23 when the seat is in the closed position to form an aperture around the entire underside of the toilet seat between the toilet seat and the toilet. The toilet seat spacers 39 prevent the toilet seat and the toilet from coming into contact and forming a tight seal. The ventilated toilet set also has a top surface that has rounded edges on which the user sits. The bottom surface 24 also forms a plurality of linear, elongated louvers 22 in the bottom surface 24 of the toilet seat to allow air to flow to the hollow inside chamber. The plurality of linear, elongated louvers 22 in the bottom surface 24 are oriented, as best shown in FIG. 2, FIG. 4*a* and FIG. 4*b*, to establish a horizontal movement of the air near the perimeter of the ventilated toilet seat 10 in order to minimize the escape of odors from the toilet bowl. FIG. 4*a* shows the opening formed by the elongated louvers 22 which allows air to flow through the linear openings 22 and into the hollow inside chamber. These elongated louvers 22 are formed at such an angle so as to cause the air to move into the hollow inside chamber and into the filter and prevent the air from escaping. The length and number of elongated louvers 22 affects the performance of the instant invention and must be designed in concert with the thickness of the filter and the power and flow rate generated by the fan 54. The fan 54 used in the preferred embodiment is a standard computer case cooling fan or equivalent. In one preferred embodiment of the instant invention, the elongated louvers 22 are formed to be ½ inches in length and 1/16 inches in width; the filter media is between 18 and 22 square inches and is between ⅛ and ⅜ inches in thickness; the fan 54 generates a nominal flow of between 15.0 and 19.0 cubic feet per minute. FIG. 4*a* shows how the air motion is induced from front to back by the orientation of the louvers. Further, this horizontal movement of air provides better control of the air under the toilet seat. FIG. 4*b* schematically shows how the proper design of the openings sheds fluid from the seat to prevent excess moisture from getting inside the hollow chamber when the seat is used in the upright position.

The orientation of the plurality of linear, elongated louvers 22 in the bottom surface is one distinguishing feature of the instant invention. These elongated louvers 22 are specifically designed and oriented to form a horizontal flow of air inside of the toilet to minimize the amount of air flow from under the toilet seat out of the toilet and into the surrounding room. In particular, the orientation of the elongated louvers 22 channel air into the inside hollow chamber tangential to the inner circumference of the toilet seat thereby creating the horizontal air flow.

Figure 9:
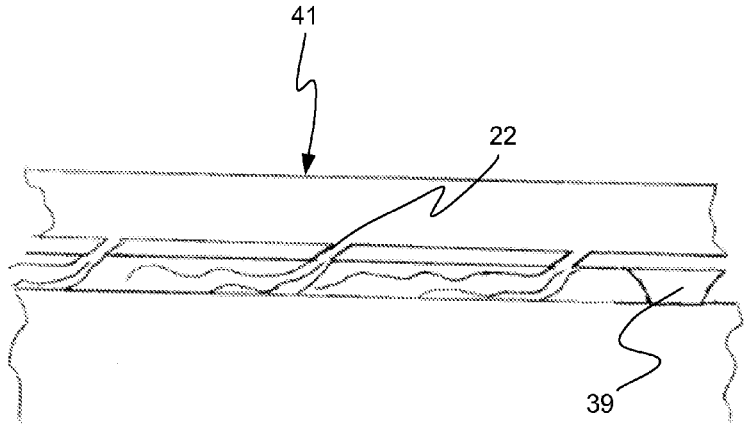
FIG. 9 shows the approximate air streamlines between the toilet seat and the toilet.
Figures 10A, 10B:
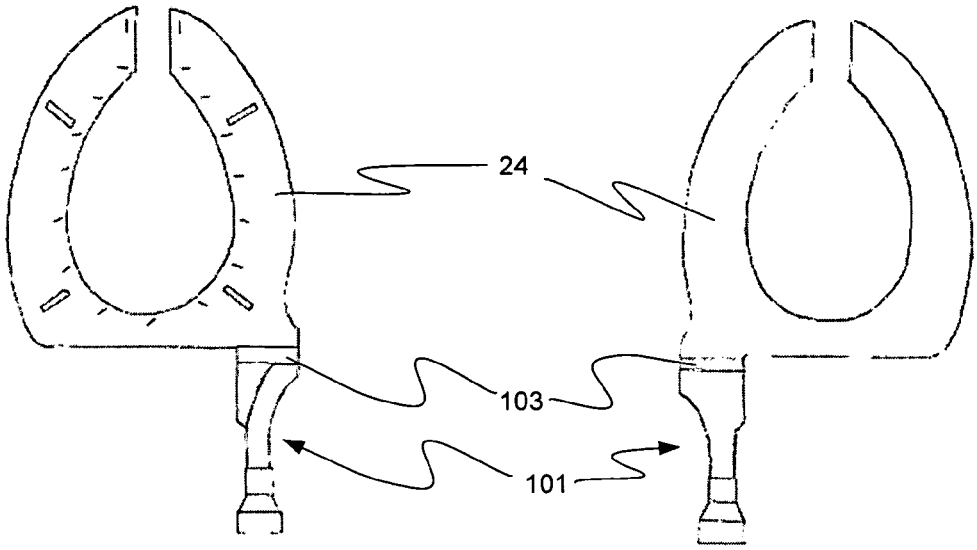
FIG. 10*a* shows a bottom view of a preferred embodiment of the instant invention comprising the spring loaded, self-adjusting connection assembly.
FIG. 10*b* shows a top view of a preferred embodiment of the instant invention comprising the spring loaded, self-adjusting connection assembly.
Figure 10C:
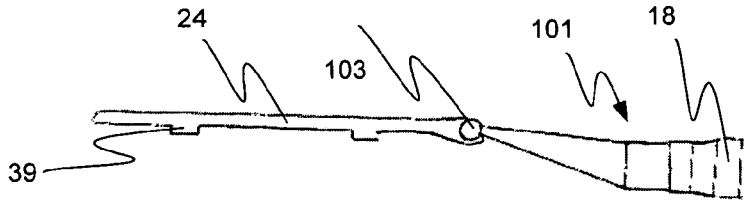
FIG. 10*c* shows a side view of a preferred embodiment of the instant invention comprising the spring loaded, self-adjusting connection assembly.
Figure 10D:
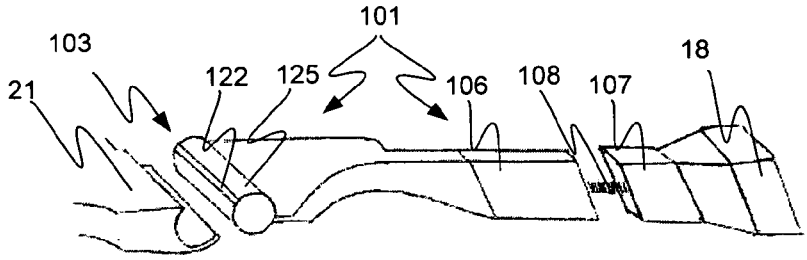
FIG. 10*d* shows a side view of a preferred embodiment of the spring loaded, self-adjusting connection assembly.

As shown in FIG. 9, the elongated louvers 22 are formed at a low angle to the underside of the toilet seat. This severe angle causes the air to move horizontal and in a direction perpendicular to the elongated louvers 22 thereby keeping the air inside the toilet seat and into the filter 52. The length, width and angle of the elongated louvers 22 can be adjusted in manufacture to account for the air moving capacity of the fan.

In one embodiment of the invention, the hollow inside chamber is used to act as a conduit for air circulation to a separate, additional chamber to adsorb the offensive odors from the air. In the most common embodiment the hollow inside chamber is used to channel air flow to the fan 54. In another embodiment the hollow inside chamber can contain porous odor adsorbing material capable of capturing offensive odors. The porous odor adsorbing material also allows air to passes through the hollow inside chamber and out through the fan 54. The elongated louvers 22 are also angled downward, towards the hinged end of the toilet seat, as shown in FIG. 4*b*, so that as liquid flows towards the hinge when the seat is raised a minimal amount of liquid enters the hollow inside chamber.

At the back of the toilet seat, near the common hinged connection found on most toilets, a rear opening 20 is formed by the toilet seat 21 in the ventilated toilet seat 10. The rear opening formed by the toilet seat serves as an exhaust port for the hollow inside chamber. This opening allows for mounting of a battery powered or wall socket powered fan 54 that withdraws air from the hollow inside chamber.

Figure 8:
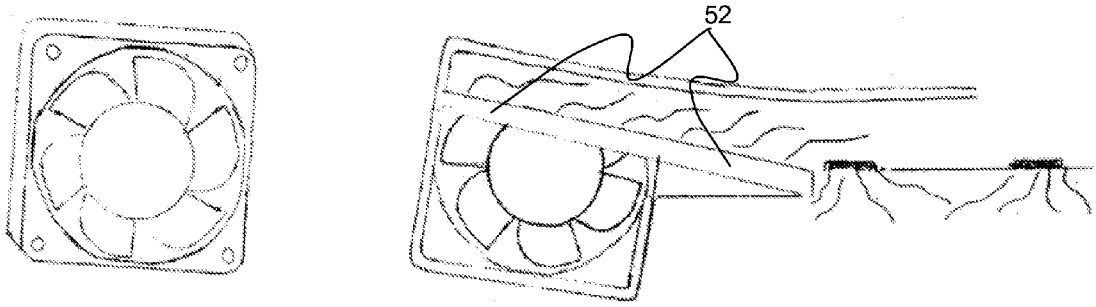
FIG. 8 shows the orientation of the fan in the filter unit in is engaged position.

A filter assembly 51 engages into the rear opening 20. The filter assembly contains a filter 52 and the fan 54. In one embodiment of the invention, the filtration material is activated carbon. The filter assembly engages into the rear open and is held in place through clips or a resistance fit built into the toilet seat. Removal of the filter assembly for maintenance is quick making the entire unit easy to service and user friendly. FIG. 8 shows how the filter unit engages into the toilet seat housing. In the embodiment when the air is exhausted back into the room, attached to the fan 54 or wall socket fan is an odor adsorbing chamber or filter 52 containing materials that are capable of adsorbing odors or adsorbing odors and freshening the air with a pleasant scent. In the embodiment where a wall socket fan 54 is used, a power adapter is employed to covert wall line power to a lower, safe voltage to be used by the wall socket powered fan 54. The fan is in-line with the pivot of the seat hinges thereby considerably reducing the mechanical shock exerted on the fan should the seat fall. The exhaust from the fan is directed downward and towards to floor, away from the toilet and user.

In another embodiment of the ventilated toilet seat 10, an embodiment contemplated for new construction where the appropriate electrical and plumbing connections can be installed, the exhaust from a wall socket powered fan 54 is channeled through ductwork or tubing to ventilation piping in the structure to be exhausted to the outside. In this embodiment, the wall socket powered fan 54 can be designed in such a manner as to be hidden from view.

Figure 6A:
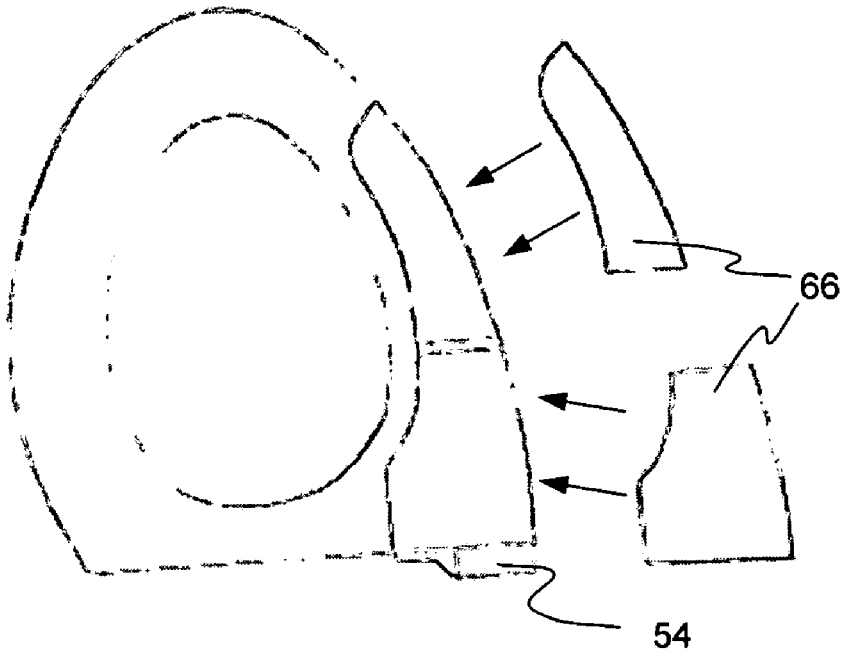
FIG. 6*a* shows one embodiment of the instant invention with the placement of the side-mount filter assembly and how the side-mount filter assembly engages into the molded toilet seat from the side of the instant invention.
Figure 6B:
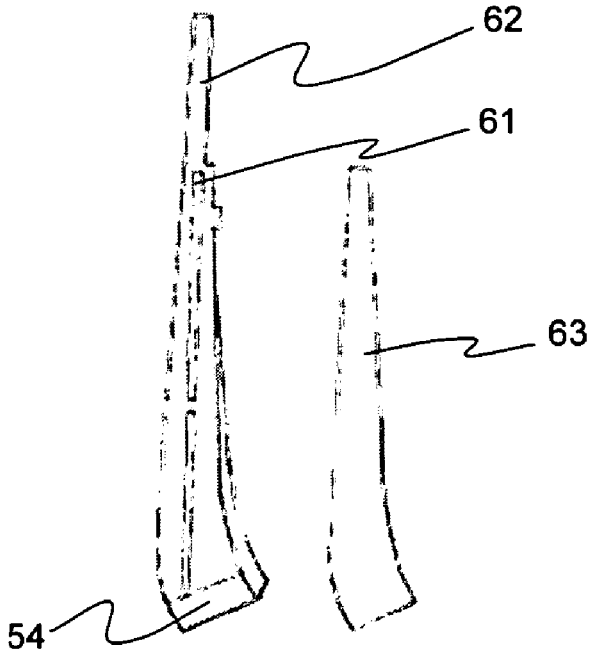
FIG. 6*b* shows one embodiment of the instant invention with the placement of the side-mount filter unit and how the side-mount filter engages into side-mount filter assembly.
Figure 7:
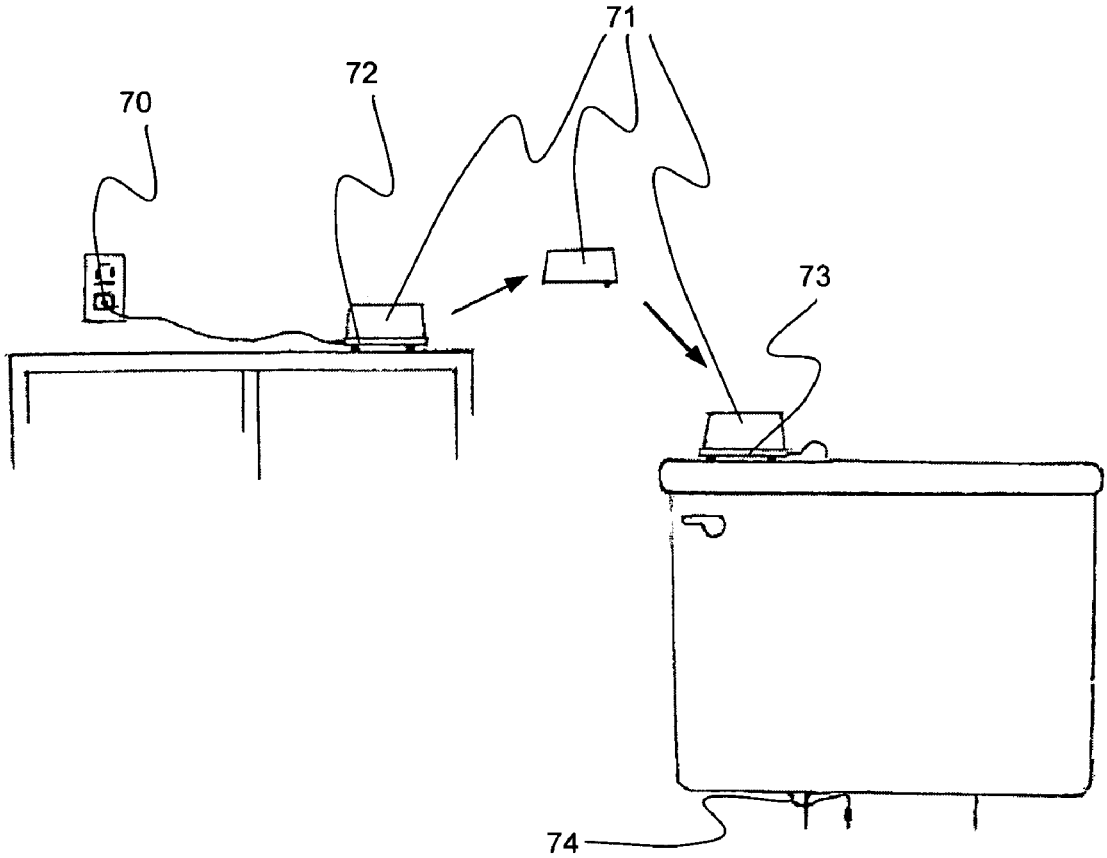
FIG. 7 shows an embodiment of one preferred location of the AC wall power supply relative to the ventilated toilet seat for the power charging unit of the battery.

In another embodiment of the instant invention 10, the ventilated toilet seat 10 is comprised of a side-mount filter assembly, which is comprised of filter media and a cover, where the side-mount filters 61 engage into the molded toilet seat from the side of the instant invention. This embodiment is shown schematically in FIG. 6*a* and FIG. 6*b*. In this embodiment, the side-mount filters 61 engages into the side-mount filter assembly 62 and the side-mount filter assembly in turn engages into the molded toilet seat from the side of the instant invention. The side-mount filter assembly 62 is covered by a side-mount filter assembly cover 63 for aesthetic purposes and to direct the flow of air.

FIG. 4*a* and FIG. 4*b* illustrate the major purpose of the design of the ventilated toilet seat which is to maintain a horizontal air flow under the seat between the seat and the toilet. The seat can be operated just as a conventional toilet seat, but when not in use the seat will not allow condensation into the seat or lid 11 when the lid is closed.

In one embodiment, the fan is powered from an external power pack that can be mounted on the side of the toilet tank 27 or placed on top of the toilet tank 27. Electrical power is supplied via an electrical cord 74 to the seat. The electrical power is routed via electrical wires to contacts mounted in the portion of the toilet seat that receives the removable fan housing. When the removable fan housing is inserted into the toilet seat, electrical contacts on the removable fan housing make electrical contact with the contacts mounted in the portion of the toilet seat that receives the removable fan housing. The electrical contacts on the removable fan housing in turn supply the power to the fan.

In one embodiment, the fan 54 is battery powered and standard batteries or rechargeable batteries can be used to power the fan 54. Also, another embodiment uses a detachable power cell 71 that connects to a power stand 72 which in turn connects to a power adapter 70 that accepts line voltage from a power wall plate. When the power cell is attached to a power transmission stand 73 power is transferred to the battery fan via an electrical connection 74.

In the most preferred embodiment, the fan 54 is powered from wall current using a power adapter 16, typically a 12V AC-DC power adapter. In this embodiment, the fan 54, is connected directly to the power adapter 16, eliminating the need for a recharging unit and battery. The instant invention is further comprised of a power switch, where the power switch is either manually controlled by the user or engaged when the toilet seat is begin used.

Figure 11:
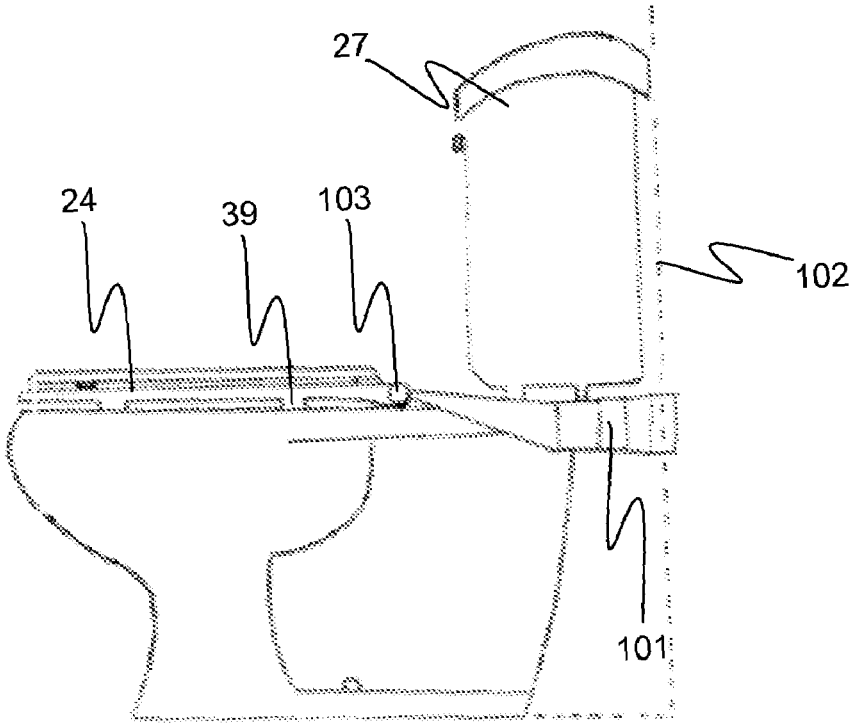
FIG. 11 shows an elevation view of the instant invention installed on a toilet showing the spring loaded, self-adjusting connection assembly connected to the wall.

In another embodiment of the invention, the instant invention is further comprised of a spring loaded, self-adjusting connection assembly 101. This connection assembly 101 enables the ventilated toilet seat to be easily connected to a ventilation system. FIG. 11 is a side view of the instant invention showing the arrangement of the spring loaded, self-adjusting connection assembly 101 in use with the instant invention. The surface of the wall 102 is represented by the dotted line in FIG. 11. The connection hinge 103 allows the toilet seat to be used in either the upward or downward position. The connection hinge 103 allows air to be drawn from the toilet seat into the connection assembly 101 when in the toilet seat is in the downward position. In the preferred embodiment using the connection assembly 101 the odors and moisture are swept into the hollow chamber as described above and as illustrated in FIG. 4*a* and FIG. 4*b*. The spring loaded action of the connection assembly 101 allows for easy removal by compressing the spring loaded action of the connection assembly 101 thereby allowing removal of the entire assembly. The spring loaded action of the connection assembly 101 also allows for a secure fit between the wall and the toilet seat.

As seen in FIG. 11 the connection assembly 101 is spring loaded so that the instant invention can be attached to the back of the instant invention via the connection hinge 103. The connection assembly 101 extends rearward, away from the instant invention to fit into a receptacle in the wall or special ductwork or filter system in the wall. The connection assembly 101, particularly the connection hinge 103, is designed to accommodate the various designs of toilets and their various proximities to the wall as installed. This embodiment of the instant invention is further comprised of a means to accept a fan. In addition, in another embodiment, the entire structure may be equipped with a powered or natural convention ventilation system preinstalled into the wall and ventilated to the attic or outside precluding the necessity for a fan.

Figure 12:
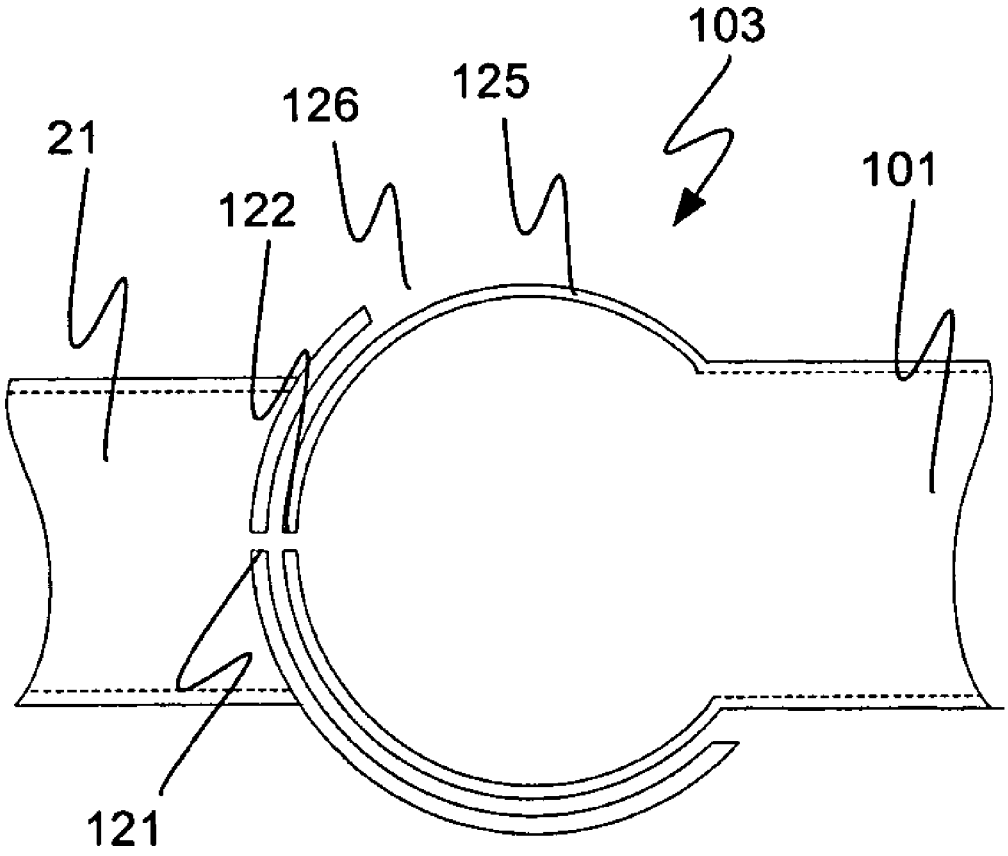
FIG. 12 shows a view of the connection hinge which is comprised inside hinge and an outside hinge 126 which connects the hollow chamber to the ventilation system.

The connection hinge 103 is comprised of a hollow cylindrical inside hinge 125 and a hollow, cylindrical receiving outside hinge 126. The inside hinge 125 is mated with cylindrical receiving outside hinge 126 as schematically shown in FIG. 12. The toilet seat 21 can be raised or lowered by rotating the outside hinge 126 around the inside hinge 125. The inside hinge 124 forms a slit opening along the longitudinal dimension of the inside hinge 124. The outside hinge 126 forms a similar slit opening along the longitudinal dimension of the outside hinge 126. When the inside hinge slit 122 is aligned with the outside hinge slit 121 the hollow chamber formed by the toilet seat is in fluid mechanical contact with the connection assembly 101 and the air inside the hollow chamber can be exhausted out of the hollow chamber, through the connection hinge 103, through the connection assembly 101 and vented.

The connection assembly 101 is also comprised of a front conduit 106 that provides a fluid connection between the hollow inside chamber in the instant invention and the rear conduit 107 which provides a fluid connection between the front conduit 106 and the fan 18. The fan 18 provides the motive force for the air to exhaust into a wall vent or other ventilation means. The front conduit 106 and the rear conduit 107 overlap and can expand and contract longitudinally. A connection assembly spring 108 under compression is situated between the front conduit 106 and the rear conduit 107 and acts to expand the connection assembly 101. The force exerted by the connection assembly spring 108 maintains the position of the connection assembly 101 between the connection hinge 103 and the wall.

In summary, the air is drawn into the elongated louvers 22, through the hollow inside chamber, the front conduit 106, the rear conduit 107, the fan 18, and exhausted to a ventilation means.

The best mode of the instant invention employs the ventilated toilet seat mounted onto a toilet via the common hinged connections found on toilets. When the user of the toilet sits on the toilet seat, the weight of the user will cause a contact switch to engage. The contact switch engages the power to the battery powered or wall fan. The fans withdraws air from the inside hollow chamber through the rear opening 20 of the instant invention. As air is withdrawn through the rear opening 20, air enters through the plurality of elongated louvers 22. The air entering the elongated louvers 22 establishes a horizontal air flow within the toilet bowl preventing the odor from entering the room. As the air exits either a battery-powered 71 fan or a wall-powered fan 54, the air is pulled through a chamber 29 containing odor adsorbing materials. In another best mode, the air is forced through a conduit to the building plumbing vent system. In another embodiment of the best mode of the instant invention, a manual push button switch 53 is employed so the user can decide if the ventilated toilet seat should be operated.

What is claimed is:

1. A ventilated toilet seat comprised of a bottom surface;

a top surface;

the bottom surface and the top surface form an essentially oval shaped inner circumference;

where the bottom surface and the top surface form a split or a non-split style ventilated toilet seat;

a hollow inside chamber that is formed by the bottom surface and the top surface of the ventilated toilet seat and where the hollow inside chamber runs inside the majority of the ventilated toilet seat;

a plurality of essentially linear elongated louvered openings formed by the bottom surface of the toilet seat to allow air to flow to the hollow chamber wherein the horizontal louvered openings are oriented tangential to the inner circumference of the toilet seat and the plurality of essentially linear elongated openings in the bottom surface are oriented such that air flow is established in a direction tangential to the essentially oval shaped inner circumference;

a fan, wherein the fan is either battery powered or wall current powered, to pull air through the louvered openings, through the hollow inside chamber;

a power switch, where the power switch is either manually controlled by the user or engaged when the toilet seat is begin used;

a rear opening or a side opening formed by the toilet seat where rear or side opening accepts a filter assembly and where the rear or side opening is connected to the hollow inside chamber;

a spring loaded connection assembly where the spring loaded connection assembly is comprised of a connection hinge where the connection hinge is comprised of a hollow cylindrical inside hinge;

a cylindrical receiving outside hinge;

the inside hinge is mated with the cylindrical receiving outside hinge;

an inside hinge slit formed by the inside hinge along the longitudinal dimension of the inside hinge; and an outside hinge slit formed by the outside hinge along the longitudinal dimension of the outside hinge;

a front conduit that provides a fluid connection between the hollow inside chamber;

a rear conduit that provides a fluid connection between the front conduit and the fan, where the front conduit and the rear conduit overlap so that the front conduit and the rear conduit and can expand and contract longitudinally;

a connection assembly spring that is under compression situated between the front conduit and rear conduit and acts to expand the connection assembly whereby the force exerted by the connection assembly spring maintains the position of the connection assembly between the connection hinge and a wall.

2. The ventilated toilet seat as described in claim 1 wherein the fan outlet is connected to an odor adsorbing chamber which is comprised of an activated carbon filter.

3. The ventilated toilet seat as described in claim 2 wherein the odor adsorbing chamber is further comprised of a means to lightly scent the air with a pleasant scent as the air leaves the odor adsorbing chamber.

* * * * *